US010112422B2

(12) United States Patent
Tremblay

(10) Patent No.: US 10,112,422 B2
(45) Date of Patent: Oct. 30, 2018

(54) METHOD OF ALIGNING A FIRST IMAGE ON A FIRST SIDE OF A MEDIUM AND A SECOND IMAGE ON A SECOND SIDE OF A MEDIUM

(71) Applicant: Océ Holding B.V., Venlo (NL)

(72) Inventor: Christian Tremblay, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/833,723

(22) Filed: Dec. 6, 2017

(65) Prior Publication Data

US 2018/0170078 A1 Jun. 21, 2018

(30) Foreign Application Priority Data

Dec. 16, 2016 (EP) ..... 16204708

(51) Int. Cl.

| | |
|---|---|
| ***B41J 3/60*** | (2006.01) |
| ***B41J 13/26*** | (2006.01) |
| ***B41J 11/00*** | (2006.01) |
| ***B41J 11/46*** | (2006.01) |

(52) U.S. Cl.

CPC ..... *B41J 13/26* (2013.01); *B41J 3/60* (2013.01); *B41J 11/008* (2013.01); *B41J 11/46* (2013.01)

(58) Field of Classification Search

CPC .. B41J 3/60; B41J 11/008; B41J 11/46; A01B 12/006

See application file for complete search history.

(56) References Cited

U.S. PATENT DOCUMENTS

| | | | | |
|---|---|---|---|---|
| 9,481,167 | B2 * | 11/2016 | Togashi | B41J 2/04581 |
| 9,736,324 | B2 * | 8/2017 | Hama | H04N 1/00527 |
| 2004/0160494 | A1 * | 8/2004 | Isono | B41J 2/14209 347/68 |

FOREIGN PATENT DOCUMENTS

EP 3 072 699 A1 9/2016

OTHER PUBLICATIONS

European Search Report for EP 16 20 4708 completed on May 23, 2017.

* cited by examiner

*Primary Examiner* — Lamson Nguyen
(74) *Attorney, Agent, or Firm* — Birch, Stewart, Kolasch & Birch, LLP

(57) ABSTRACT

A method of aligning a first image on a first side of a medium and a second image on a second side of a medium, the first side and the second side facing away from each other, includes using an imaging device for printing the first image and a discrimination feature including a discriminatory edge perpendicular to an alignment direction in a coordinate system of the medium on a first side of the medium while controlling the position of the medium with respect to a coordinate system of the imaging device based on a first set of feed parameters and using the imaging device for printing the second image and a plurality of features on the second side of the medium while controlling the position of the medium in the coordinate system of the imaging device based on a second set of feed parameters, the plurality of features including a first feature, a second feature and a third feature.

5 Claims, 4 Drawing Sheets

METHOD OF ALIGNING A FIRST IMAGE ON A FIRST SIDE OF A MEDIUM AND A SECOND IMAGE ON A SECOND SIDE OF A MEDIUM

FIELD OF THE INVENTION

In a prior art method of printing a first image on a first side of a roll of paper and a second image on a second side of paper, a vision system is used to align the second image with the first image.

BACKGROUND OF THE INVENTION

On the first side a first alignment mark is printed by a printer. The first alignment mark consists of 4 squares recorded in such relative positions and orientations that the edges facing away from the other squares are on edges of an imaginary enveloping square. Between the 4 squares there is an open space forming a first cross.

In the prior art method the first image is printed on the first side.

In addition, on the first side a first alignment mark is printed. The first alignment mark consists of 4 squares recorded in such relative positions and orientations that the edges facing away from the other squares are on edges of an imaginary enveloping square. Between the 4 squares there is an open space forming a first cross.

After printing the first image and the first alignment mark, the paper is removed from the printer and fed back in the printer such that the second image can be printed on the second side.

A light source facing the first side of the paper is positioned such that the paper is between the light source and the camera of the vision system. The light source is used to arrange that the first alignment mark is visible through the medium when looking at the second side. A camera facing the second side captures an image of the first alignment mark and projects a second cross on the image. Settings in the printer are then adjusted such that the second cross is between the 4 squares overlapping the first cross. The first cross has wider features than the second cross such that by positioning the medium, the second cross does not overlap with any of the 4 squares.

Then a second alignment mark is printed on the second side, the second alignment mark being an image of the second cross. In addition the second image is printed on the second side. The second alignment mark is printed for later review of the process.

As the human eye is not a calibrated measuring device, it is difficult for an operator to see if the second cross is placed exactly in the middle between the squares in the first cross. In fact even a misalignment in a positive direction may be judged by the operator as a misalignment in a negative direction which would lead to an adjustment increasing the misalignment.

It is an object of the invention to provide a method that improves the accuracy of the alignment method.

SUMMARY OF THE INVENTION

According to the invention there is provided a method of aligning a first image on a first side of a medium and a second image on a second side of a medium, the first side and the second side facing away from each other, wherein the method comprises the steps of using an imaging device for printing the first image and the a discrimination feature comprising a discriminatory edge perpendicular to an alignment direction in a coordinate system of the medium on a first side of the medium while controlling the position of the medium with respect to a coordinate system of the imaging device based on a first set of feed parameters and using the imaging device for printing the second image and a plurality of features on the second side of the medium while controlling the position of the medium in the coordinate system of the imaging device based on a second set of feed parameters, the plurality of features comprising a first feature, a second feature and a third feature;

each feature of the plurality of features having a first edge and having a second edge parallel to the first edge and having a halfway coordinate between the first edge and the second edge; the halfway coordinate of the second feature being between the halfway coordinate of the first feature and the third feature, the first feature extending in a first range of coordinates in the alignment direction, the second feature extending in a second range of coordinates in the alignment direction, the third feature extending a third range of coordinates in the alignment direction, the first range overlapping with the second range and the second range overlapping with the third range;

wherein printing comprises controlling a printing position where the medium is to be colored, in the coordinate system of the imaging device;

wherein when printing the discrimination feature and the plurality of features, the relative positioning of the medium in the coordinate system of the imaging device and controlling the printing position are arranged such that according to the first set of feed parameters and the second set of feed parameters the first edges of the features of the plurality of features are perpendicular to the alignment direction and the discriminatory edge overlaps the first edge of the second feature.

For the invention to work, the first image and discrimination feature may be printed before or after printing the second image and the plurality of features. First and second are used in relation to the images and the sides of the medium only to discriminate between the two images and sides not the order of printing.

Thus, the first image and the discrimination features may in time be printed first on the first side or the second image and the plurality of features may be printed on the second side after which the first image and the discrimination feature are printed.

The alignment direction is coupled to the medium whereas the printing position is controlled in the coordinate system of the imaging device. The medium and the printing position may not necessarily be moved relatively (exactly) in the alignment direction: the alignment direction may even be perpendicular to the direction movement. As the second edges of the features of the plurality of features are parallel to the first edges and because the medium is arranged such that the first edges are perpendicular to the alignment direction, so are the second edges. Obviously a tolerance will be applicable in any realization.

Because the discriminatory feature and the first image are printed while controlling the position of the medium with respect to the coordinate system of the medium in the coordinate system of the imaging device based on the first set of feed parameters, the positions and orientation of the discriminatory feature and the first image are tied together in the coordinate system of the medium.

Because the plurality of features and the second image are printed while controlling the position of the medium with respect to the coordinate system of the medium in the coordinate system of the imaging device based on the second set of feed parameters, the positions and orientation of the plurality of features and the second image are tied together in the coordinate system of the medium.

Because it is arranged that according to the first set of feed parameters and the second set of feed parameters the first edges of the features of the plurality of features are perpendicular to the alignment direction and the discriminatory edge overlaps the first edge of the first edge of the second feature, and the halfway coordinate of the second feature is between the halfway coordinates of the first feature and the third feature and the coordinate ranges overlap between the first and second and between the second and third features, the method makes it easy to visually determine if the discrimination feature is exactly aligned or if there is a deviation in the alignment direction and if this is the direction of increasing coordinates along the alignment direction or decreasing coordinates along the alignment direction.

This deviation can be caused by any tolerance in determining the relative positions based on the feed parameters. Feed parameters for instance are the distance the medium is transported after measuring an initial position of the medium for instance based on an edge of the medium.

The determination of the deviation can be performed by a human operator or by a technical vision system.

In an embodiment of the invention, the method comprises printing the discriminatory feature with a dimension with a first value in the alignment direction printing the plurality of features such that the distance of the halfway coordinate of the first feature to the halfway coordinate of the second feature is half the first value and is equal to the distance of the halfway coordinate of the second feature to the halfway coordinate of the third feature and printing the first feature, the first feature, the second feature and the third feature with a dimension with the first value in the alignment direction.

Because the distances between the halfway points are equal and in addition the discrimination feature and first, second and third features have the same dimension in the alignment direction, the method provides a printed product for which it is easier for a human operator using his eyes to determine the degree of deviation in the alignment direction. For instance with a deviation of half the first value, the discriminatory edge of the discrimination feature is exactly aligned with the first edge of either the first feature or the third feature. This enables adjustment based upon a human operator with more precision.

In an embodiment of the invention, the discrimination feature and the features in the plurality of features are rectangular.

By the rectangular shape, the method provides features for which the determination of the deviation by a human operator is even easier.

In an embodiment of the invention, the method comprises determining whether the discrimination feature is best aligned with the first feature, the second feature or the third feature.

By determining the feature to which the discrimination feature is best aligned the misalignment can be determined efficiently.

In an embodiment of the invention, the method comprises adjusting the first set of feed parameters or the second set of feed parameters to a third set of feed parameters based on the determination; and printing a further image.

By adjusting the feed parameters based on the determination, alignment of the images on the first side and the second side is improved starting with the further image. It will be clear to the person skilled in the art that the further image will be on the first side if the first set of feed parameters is changed and that the further image will be on the second side if the second set of feed parameters is changed.

BRIEF DESCRIPTION OF THE DRAWINGS

Examples of the invention will now be described in conjunction with the drawings, wherein.

DETAILED DESCRIPTION OF EMBODIMENTS

Figure 1:
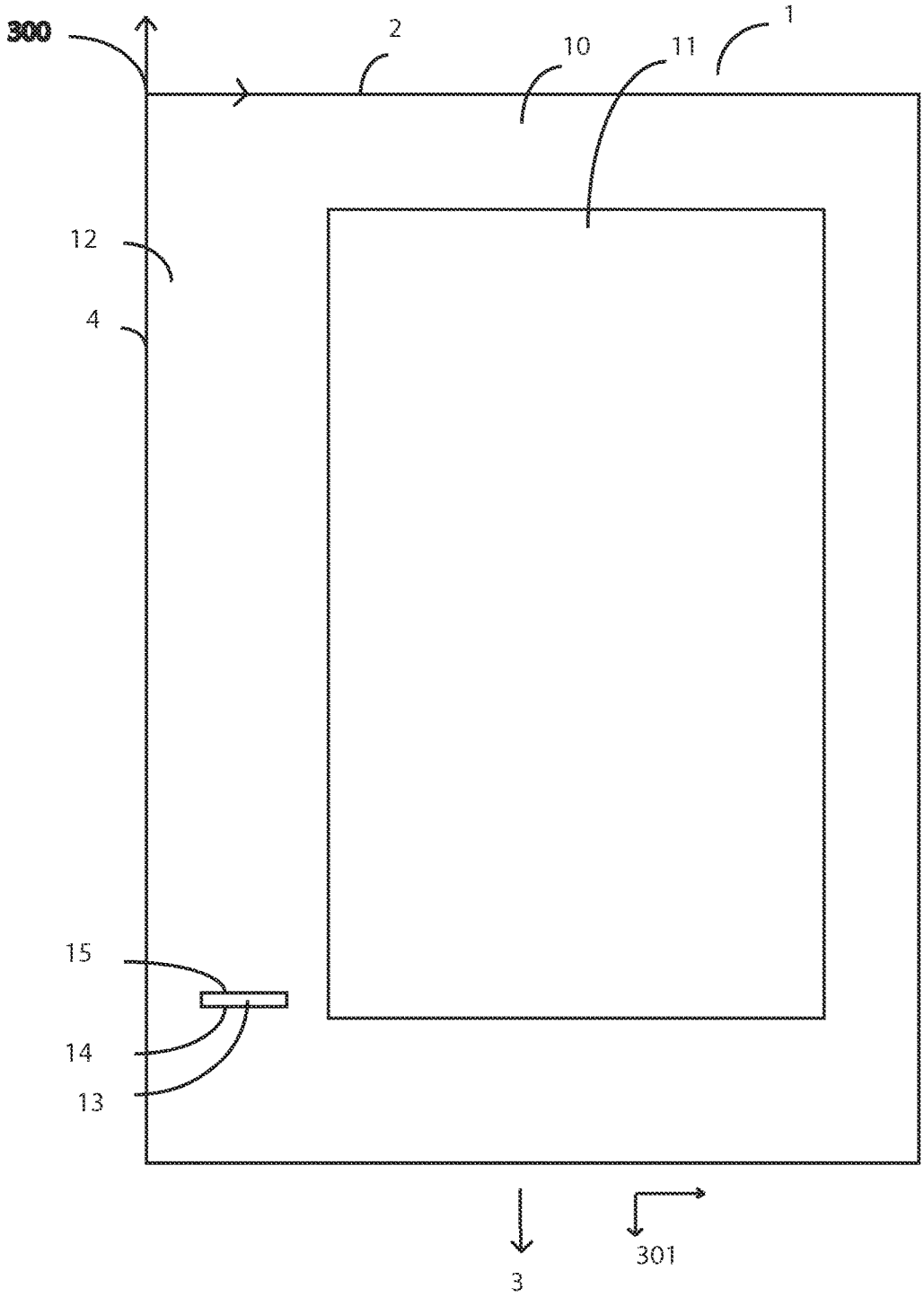
FIG. 1 depicts a discrimination feature and a first image on a medium

In an example of the invention a medium (1) is formed by a roll (not shown) of paper wound around a first cylinder (not shown). The roll of paper is fed into an imaging device (not shown) capable of printing images on the roll of paper. To start imaging, the medium (1) is partially taken from the roll starting at a first medium edge (2) on the exterior of the roll (FIG. 1). The medium (1) is then fed through the imaging device such that it passes an imaging station being transported by rotating rollers supporting the medium while keeping the medium flat.

Figure 2:
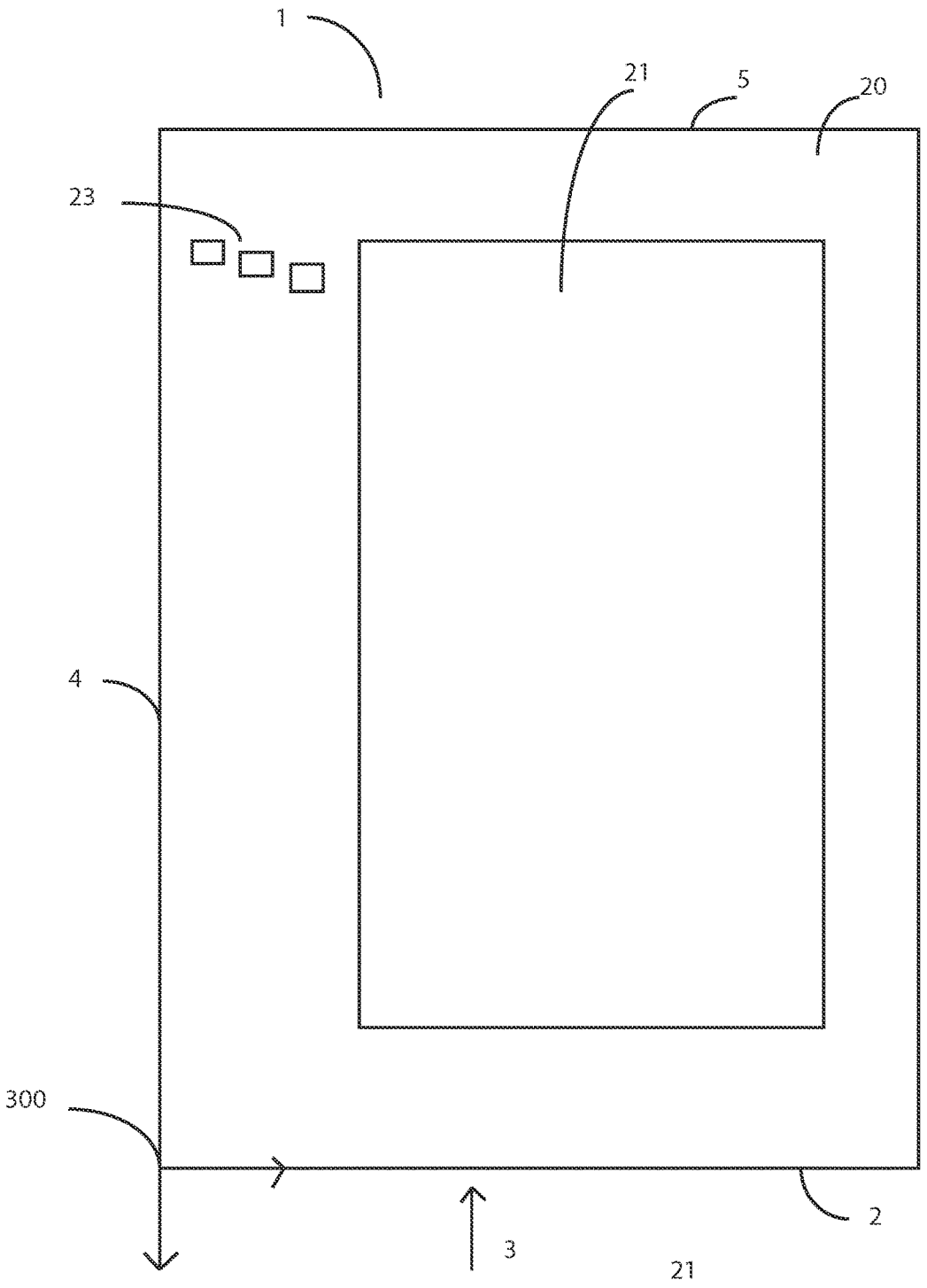
FIG. 2 depicts a plurality of features and a second image on a medium

While feeding the medium (1) through the imaging device, the first medium edge (2) of the medium is detected at an initial position by a detector in the imaging device, the first medium edge being perpendicular to the direction (3) in which the medium is fed (in FIG. 1 and FIG. 2 the arrow points to the side of the medium that enters the imaging device last). Parts of the medium that have been printed upon at the imaging station, are transported further and wound around a second cylinder.

From the moment of detecting the first medium edge (2) of the medium (1) at the initial position, the imaging device tracks the length of the medium passing the initial position by measuring the number of revolutions of the rollers and multiplying that number by the circumference of the rollers. The length of medium (1) that passed the initial position forms a part of a first set of feed parameters. The first set of feed parameters is stored in the imaging device.

While detecting the first medium edge (2), the position of a second medium edge (4) of the medium is detected. The second medium edge (4) is perpendicular to the first medium edge (2).

The position where the first medium edge (2) and the second medium edge (4) cross, forms the origin (300) of a coordinate system of the medium corresponding to a state wherein the medium would be completely unwound and flat. In this example, the direction of feeding (3) the medium coincides with an alignment direction (301), herein also referred to as x-direction.

The initial position forms the origin of a coordinate system of the imaging device. The coordinate system of the imaging device and the coordinate system of the medium are tied together by the steps of detecting the first medium edge (2) and the second medium edge (4). The relationship between the coordinate system of the imaging device and the coordinate system of the medium is stored in the imaging device.

The medium (1) is fed through the imaging device such that the position of the second medium edge (4) is kept constant in a coordinate system of the imaging device, i.e. the second edge has a constant coordinate in a y-direction. This coordinate is also stored as part of the first set of feed parameters.

While feeding the medium (1) trough the imaging device a number of images is printed on a first side (10) of the medium including a first image (11). A number of print heads that are moveable in the direction perpendicular to the alignment direction (301) is used to print the number of images.

By moving the print heads in the direction perpendicular to the alignment direction (301), here also y-direction, and maintaining the medium (1) in a fixed position in the coordinate system of the imaging device before feeding the medium to a next fixed position and printing a next line, a first image of the number of images is printed line by line. The first image is rectangular (11).

Between printing the lines, the medium (1) is transported in the alignment direction (301). The first image (11) is smaller in the y-direction than the medium (1). On both sides of the first image (11) there is an open space on the medium (1), i.e. there is a margin (12) on both sides of the first image.

In one margin (12), a discrimination feature (13) is printed (FIG. 1) on the left side of the first image (11). The discrimination feature (13) is rectangular having a dimension with a first value in the x-direction. The discrimination feature (13) is printed with one of the last lines of the first image to be printed. The position of the discrimination feature (13) is stored as part of the first set of feed parameters in terms of the length of medium (1) that has passed the initial position and the distance from the second medium edge (4). The discrimination feature comprises a first discriminatory edge (14) and a second discriminatory edge (15). The first discriminatory edge (14) is further away from the first medium edge of the medium than the second discriminatory edge (15).

After completing printing images on the first side (10) of the medium (1), the roll is completely unwound from the first cylinder. A third medium edge (5) parallel to the first medium edge (2) forms the end of the medium. The length of the medium (1) that has passed the initial position corresponding to the third medium edge (5) also is stored as a part of the first set of feed parameters.

Once the medium (1) is completely unwound from the first cylinder, fed through the imaging device and wound around the second cylinder, the second cylinder is taken from the imaging device and placed in the imaging device again thereby replacing the first cylinder such that instead of the first side (10) a second side (20) of the medium will face the number of print heads, the first side and the second side being opposing sides of the medium (FIG. 2). The medium (1) is fed trough the imaging device again. In this case the third medium edge (5) first passes the detector before the first edge (2).

From the moment of detecting the third medium edge (5) of the medium (1) at the initial position, the imaging device tracks the length of the medium passing the initial position by measuring the number of revolutions of the rollers and multiplying that number by the circumference of the rollers described earlier. The length of the medium (1) that passed the initial position forms a part of a second set of feed parameters. The second set of feed parameters is stored in the imaging device.

The length of the medium (1) from the third medium edge (5) to the position of the discrimination feature (13) is calculated.

A plurality of features (23) is printed on the second side (20) of the medium in the left margin between the second medium edge and a second image (21). The second image (21) is rectangular as well. It is intended that the second image (21) has the same size as the first image (11) and is printed behind the first image such that the first image and the second image overlap completely. This complete overlap is arranged on the basis of the first set of feed parameters and the second set of feed parameters and by controlling printing nozzles to eject ink in a printing position in the coordinate system of the imaging device.

Figure 3:
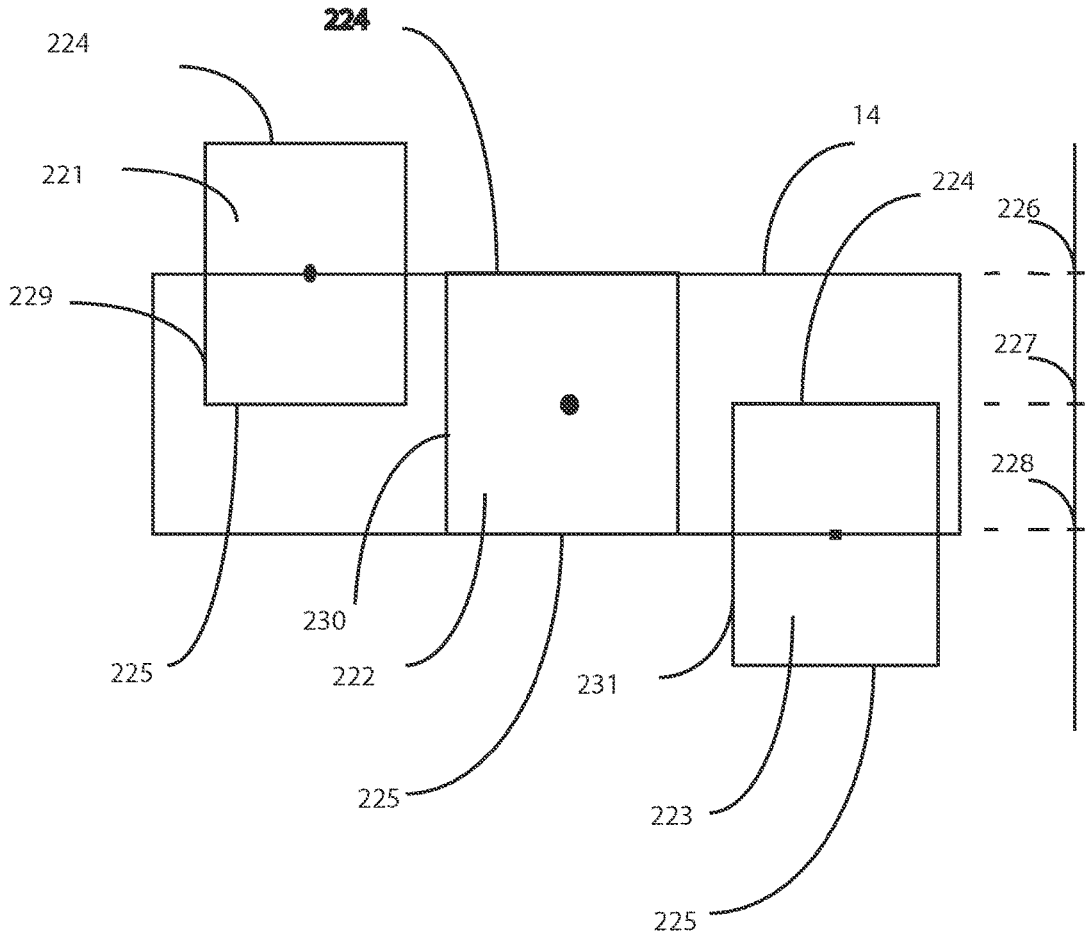
FIG. 3 depicts an overlapping discrimination feature and plurality of features

The plurality of features (23) comprises a first feature (221), a second feature (222) and a third feature (223). The first feature, the second feature and the third feature are each rectangular and equal in size. Each feature (221,222,223) of the plurality of features (23) has a first edge (224) perpendicular to the alignment direction (301) and has a second edge (225) parallel to the first edge. Also, each feature of the plurality of features has a halfway coordinate (226,227,228) between the first edge (224) and the second edge (225) in the coordinate system of the medium. The halfway coordinate (227) of the second feature (222) is between the halfway coordinate (226) of the first feature and the halfway coordinate (228) third feature. In FIG. 3. the halfway coordinates (226,227,228) are indicated by a projection of a center point (indicated by a dot) on a line.

The first feature (221) extends in a first range (229) of coordinates in the alignment direction (301), the second feature extends in a second range (230) of coordinates in the alignment direction (301) and the third feature extends a third range (231) of coordinates in the alignment direction (301). The first range (229) of coordinates, the second range (230) of coordinates and the third range (231) of coordinates are all in the coordinate system of the medium. The first range (229) overlaps with the second range (230) and the second range overlaps with the third range (231).

The plurality of features (23) is printed on the second side (20) of the medium (1) on such a position, i.e. with such coordinates, that the first discriminatory edge (14) of the discrimination feature overlaps with the first edge (224) of the second feature (222).

The discriminatory feature (13) and the features (221,222, 223) in the plurality of features (23) all have the same dimension with a first value in the alignment direction (301).

The distance between the halfway coordinate (227) of the second feature (222) and the halfway coordinate (226) of the first feature (221) is half the first value. Similarly, the distance between the halfway coordinate (227) of the second feature (222) and the halfway coordinate (228) of the third feature (223) is half the first value.

Ideally, the discriminatory feature (13) and the second feature (222) overlap perfectly, i.e. there are two pairs of edges perpendicular to the alignment direction (301) having equal coordinates. This is shown in FIG. 3. Here the printing position is arranged such that the distance from the first medium edge (2) to the first discriminatory edge (14) is equal to the distance from the first medium edge (2) to the first edge (224) of the second feature (222) by calculating the distance from the third medium edge to the first edge (224) of the second feature taking into account the length of the medium (1) that has passed the initial position corresponding to the third medium edge (5) as stored as part of the first set of feed parameters.

Figure 4:
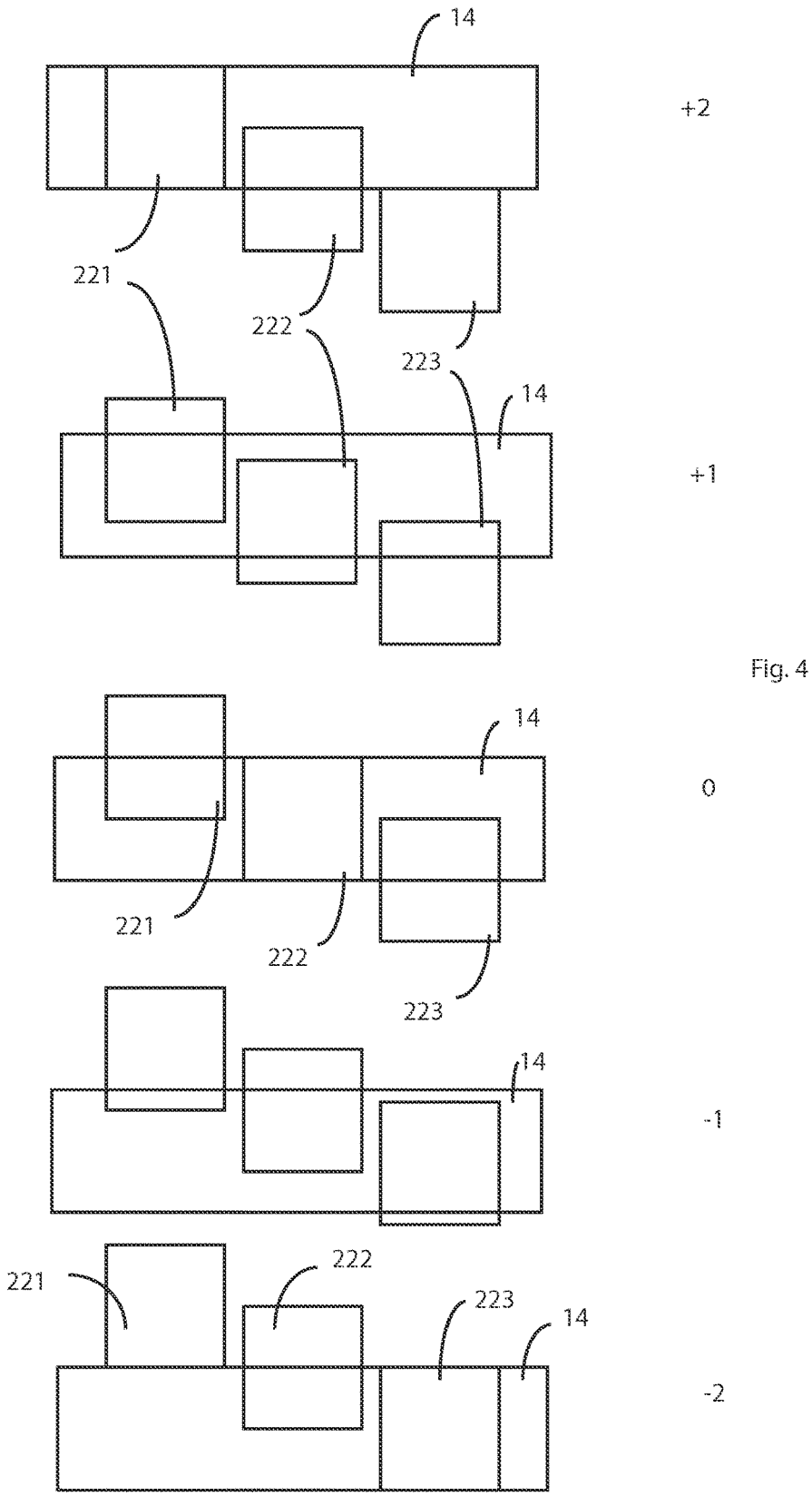
FIG. 4 depicts the overlapping discrimination feature and plurality of features in different relative positions.

However, in practise, the perfectly overlap is not realistic and deviations to either side are possible (FIG. 4). In FIG. 4 the same view of the medium (1) is shown as in FIG. 3, the difference being different relative positions of the discrimination feature and the plurality of features (23). A camera is used by the imaging device to determine if the discrimination feature is best aligned to the first feature (221), the second feature (222) or the third feature (223). The transparency of the paper material of the medium (1) is conform a 80 gr A4 sheet paper. A light source facing the medium is placed such that the medium (1) is between the light source and the camera. In this phase of the example, the light source is facing the first side (10) of the medium (1) and the camera is facing the second side (20) of the medium (1). The use of the light source makes that the visibility of the discrimination feature is sufficient for the camera.

In this example, the determination is performed by the imaging device automatically, i.e. without the interference of a human operator. Being best aligned with the first feature corresponds to the situation marked −2 in FIG. 4. Being best aligned with the second feature corresponds to the situation marked 0 in FIG. 4. Being best aligned with the third feature corresponds to the situation marked +2 in FIG. 4. In FIG. 4, the situation marked −1 indicates the situation wherein the discrimination feature (13) is equally well aligned to the first feature (221) as to the second feature (222). Similarly, the situation marked +1 indicates the situation wherein the discrimination feature (13) is equally well aligned to the second feature (222) as to the third feature (223). In such situation, it is not relevant which of the plurality of features (23) is chosen as having the best alignment with the discrimination feature (13).

In case the first feature (221) is determined to have the best alignment with the discrimination feature, an offset is stored in a memory of the imaging device. The offset is equal to the first value. Printing of a further image on the second side (20) is performed by accounting for the determined offset. This process may be repeated to the determine a cumulative offset for maintaining optimal alignment of images on the first side (10) of the medium (1) with images on the second side (20) of the medium (1).

In another example, a human operator determines which of the features of the plurality of features (23) is best aligned with the discrimination feature. In this example, the use of the light source makes that the visibility of the discrimination feature is sufficient for the human eye.

The invention claimed is:

1. A method of aligning a first image on a first side of a medium and a second image on a second side of a medium, the first side and the second side facing away from each other, wherein the method comprises the steps of:

using an imaging device for printing the first image and a discrimination feature comprising a discriminatory edge perpendicular to an alignment direction in a coordinate system of the medium on a first side of the medium while controlling the position of the medium with respect to a coordinate system of the imaging device based on a first set of feed parameters; and using the imaging device for printing the second image and a plurality of features on the second side of the medium while controlling the position of the medium in the coordinate system of the imaging device based on a second set of feed parameters, the plurality of features comprising a first feature, a second feature and a third feature, wherein each feature of the plurality of features has a first edge and a second edge parallel to the first edge and has a halfway coordinate between the first edge and the second edge, the halfway coordinate of the second feature being between the halfway coordinate of the first feature and the third feature, the first feature extending in a first range of coordinates in the alignment direction, the second feature extending in a second range of coordinates in the alignment direction, the third feature extending a third range of coordinates in the alignment direction, the first range overlapping with the second range and the second range overlapping with the third range, wherein printing comprises controlling a printing position where the medium is to be colored, in the coordinate system of the imaging device, and wherein when printing the discrimination feature and the plurality of features, the relative positioning of the medium in the coordinate system of the imaging device and controlling the printing position are arranged such that according to the first set of feed parameters and the second set of feed parameters the first edges of the features of the plurality of features are perpendicular to the alignment direction and the discriminatory edge overlaps the first edge of the second feature.

2. The method according to claim 1, further comprising the steps of:

printing the discriminatory feature with a dimension with a first value in the alignment direction;

printing the plurality of features such that the distance of the halfway coordinate of the first feature to the halfway coordinate of the second feature is half the first value and is equal to the distance of the halfway coordinate of the second feature to the halfway coordinate of the third feature; and printing the first feature, the second feature and the third feature with a dimension with the first value in the alignment direction.

3. The method according to claim 1, wherein the discrimination feature and the features in the plurality of features are rectangular.

4. The method according to claim 1, further comprising the step of determining whether the discrimination feature is best aligned with the first feature, the second feature or the third feature.

5. The method according to claim 4, further comprising the steps of:

adjusting the first set of feed parameters or the second set of feed parameters to a third set of feed parameters based on the determination; and printing a further image.

* * * * *